US009156301B2

(12) United States Patent
Flesher

(10) Patent No.: US 9,156,301 B2
(45) Date of Patent: Oct. 13, 2015

(54) POP-UP GREETING CARD WITH CONFETTI

(71) Applicant: American Greetings Corporation, Cleveland, OH (US)

(72) Inventor: Melissa Flesher, Avon, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/599,512

(22) Filed: Jan. 18, 2015

(65) Prior Publication Data

US 2015/0135564 A1 May 21, 2015

Related U.S. Application Data

(63) Continuation-in-part of application No. 14/466,605, filed on Aug. 22, 2014, now Pat. No. 9,027,269, which is a continuation-in-part of application No. 13/470,499, filed on May 14, 2012, now Pat. No. 9,056,517, which is a continuation-in-part of application No. 12/974,287, filed on Dec. 21, 2010, now Pat. No. 8,322,058.

(60) Provisional application No. 61/888,193, filed on Oct. 8, 2013, provisional application No. 61/485,298, filed on May 12, 2011.

(51) Int. Cl.

| | |
|---|---|
| ***G09F 1/06*** | (2006.01) |
| ***B42D 15/04*** | (2006.01) |
| ***B42D 15/02*** | (2006.01) |
| ***A63H 37/00*** | (2006.01) |
| *B42D 25/20* | (2014.01) |

(52) U.S. Cl.

CPC ..... *B42D 15/045* (2013.01); *A63H 37/00* (2013.01); *B42D 15/022* (2013.01); *B42D 15/027* (2013.01); *B42D 15/04* (2013.01); *B42D 25/285* (2014.10)

(58) Field of Classification Search

CPC ..... G09F 1/06; G09F 1/08; G09F 1/04; B42D 15/042; B42D 15/045; A63H 37/00; A63H 13/16

See application file for complete search history.

(56) References Cited

U.S. PATENT DOCUMENTS

| | | | | |
|---|---|---|---|---|
| 4,787,160 | A | 11/1988 | Balsamo | |
| 5,199,745 | A | 4/1993 | Balsamo | |
| 5,263,890 | A | 11/1993 | Dent | |
| 5,275,285 | A * | 1/1994 | Clegg | 206/449 |
| 5,487,706 | A | 1/1996 | Wilk | |
| 5,954,563 | A | 9/1999 | Spriggs | |
| 6,869,369 | B2 * | 3/2005 | Fairweather | 472/52 |
| 6,966,135 | B1 | 11/2005 | McDonald | |

(Continued)

FOREIGN PATENT DOCUMENTS

FR 2790423 A1 * 9/2000

*Primary Examiner* — Casandra Davis

(74) *Attorney, Agent, or Firm* — Christine Flanagan

(57) ABSTRACT

An interactive electronic greeting card with pop up feature includes a three-sided pocket or cavity which houses various electronic and mechanical components and a pop up element. In a first position, the pop up element is substantially contained within the greeting card pocket or cavity. When the push button is depressed, the pop up element is ejected or "pops up" out of the greeting card pocket or cavity, revealing a greeting or other printed indicia. The push button also initiates playback of a pre-loaded digital audio file, which may be a spoken message, a sound, a song, music or other such audio recording.

18 Claims, 15 Drawing Sheets

(56) References Cited

U.S. PATENT DOCUMENTS

| | | | |
|---|---|---|---|
| 7,546,702 | B2 | 6/2009 | Malkovas |
| 7,552,553 | B2 | 6/2009 | Kelly |
| 7,694,445 | B2 | 4/2010 | Kelly |
| 7,717,347 | B2 | 5/2010 | Boyd et al. |
| 7,793,446 | B2 | 9/2010 | Hluchan |
| 7,861,441 | B1 | 1/2011 | Hoellwarth |
| 2006/0135037 | A1 | 6/2006 | Newland et al. |
| 2007/0284269 | A1 | 12/2007 | Star |
| 2008/0229633 | A1 | 9/2008 | Yi |
| 2009/0013567 | A1 | 1/2009 | Hluchan |
| 2009/0214802 | A1 | 8/2009 | Sedlacko |
| 2009/0217559 | A1 | 9/2009 | Sayre |
| 2011/0126437 | A1 | 6/2011 | Bullington |
| 2012/0048766 | A1 | 3/2012 | Glass et al. |

* cited by examiner

POP-UP GREETING CARD WITH CONFETTI

RELATED APPLICATIONS

This application is a continuation-in-part of U.S. patent application Ser. No. 14/466,605 filed on Aug. 22, 2014, which is a non-provisional of U.S. Provisional Patent Application No. 61/888,193, filed on Oct. 8, 2013 and also a continuation-in-part of U.S. patent application Ser. No. 13/470,499 filed on May 14, 2012, which is the non-provisional of U.S. Provisional Patent Application No. 61/485,298 filed on May 12, 2011 and also a continuation-in-part of U.S. patent application Ser. No. 12/974,287, filed on Dec. 21, 2010 (now U.S. Pat. No. 8,322,058). Copies of the above-referenced patent documents are incorporated herein by reference in their entirety.

FIELD OF THE INVENTION

The present invention is in the field of social expression and entertainment products, and more specifically to greeting cards with mechanical and electronic functions and features.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. Cards with mechanical or structural features such as three-dimensional "pop-ups" are conventionally made with multiple panels or pages which are attached at various locations to unfold in multiple planes. A particular challenge to incorporate mechanical movement in a greeting card is to do so without making the card too bulky or thick, so that it has the same general configuration and size as conventional flat panel cards.

SUMMARY OF THE INVENTION

An interactive electronic greeting card with pop up feature includes a pocket or cavity which houses various electronic and mechanical components and a pop-up element. In a first position, the pop-up element is substantially contained within the greeting card pocket or cavity. In a second position, the pop-up element is substantially outside the greeting card pocket or cavity. A push button controls movement of the pop-up element between the first and second positions. Pressing the push button causes the pop-up element to be ejected or to "pop up" out of the greeting card pocket or cavity, revealing a greeting or other printed indicia. The push button also initiates playback of a pre-loaded digital audio file, which may be a spoken message, a sound, a song, music or other such audio recording. Manually pushing the pop-up element back into the cavity ends playback of the audio.

DETAILED DESCRIPTION OF PREFERRED AND ALTERNATE EMBODIMENTS

The greeting card of the present invention combines a spring loaded pop-up element and sound capability with a greeting card having push button activation. The push button requires user interaction with the greeting card in order to reveal the pop-up element and to initiate playback of a pre-loaded digital sound file. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity.

Figure 2:
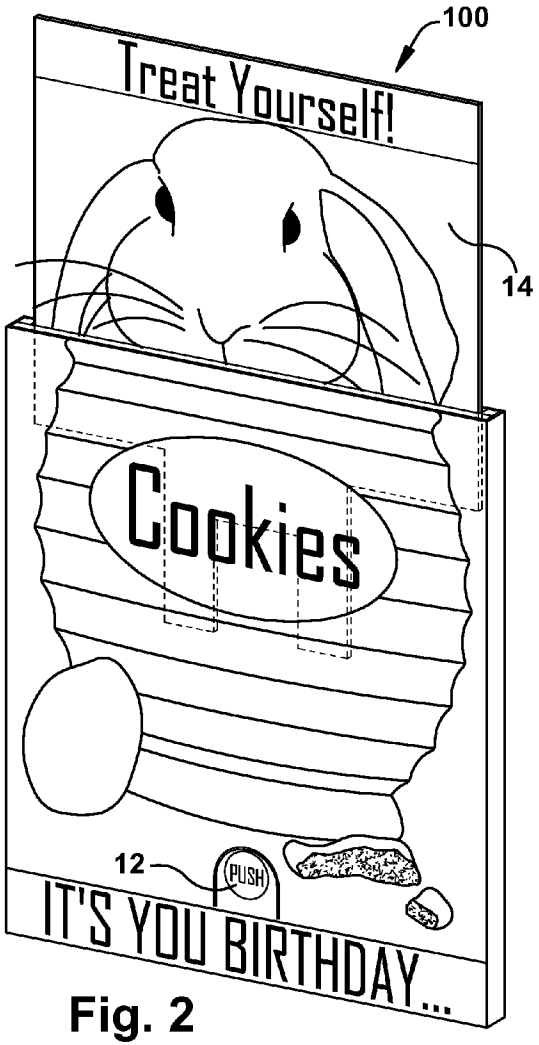
FIG. 2 is a perspective view of the Pop-Up Greeting Card of FIG. 1, in a second position.
Figure 1:
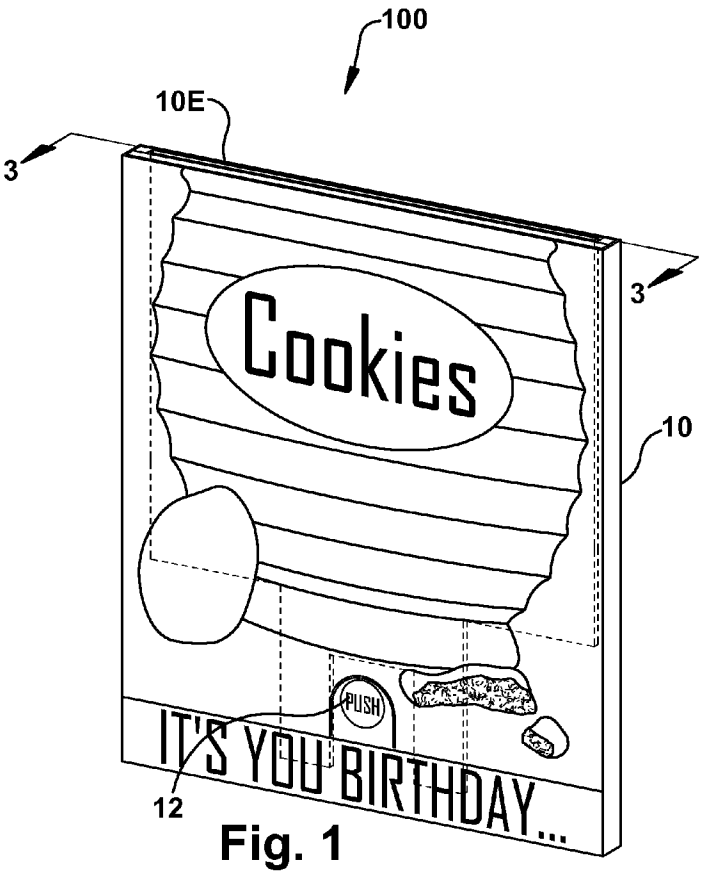
FIG. 1 is a perspective view of a first embodiment of the Pop-Up Greeting Card of the present invention, in a first position.
Figure 3:
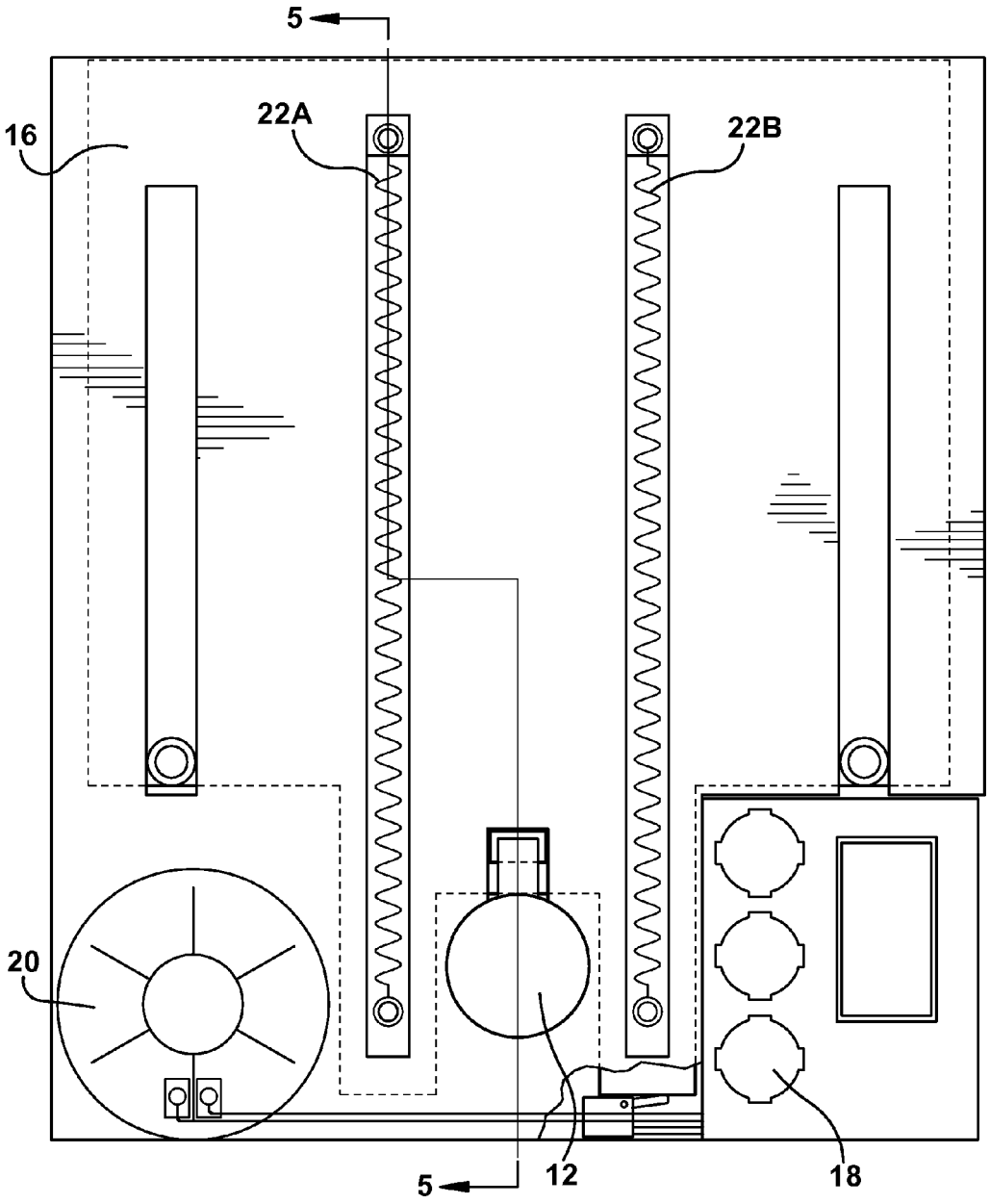
FIG. 3 is a front view of the internal components of the Pop-Up Greeting Card of FIG. 1.
Figure 4:
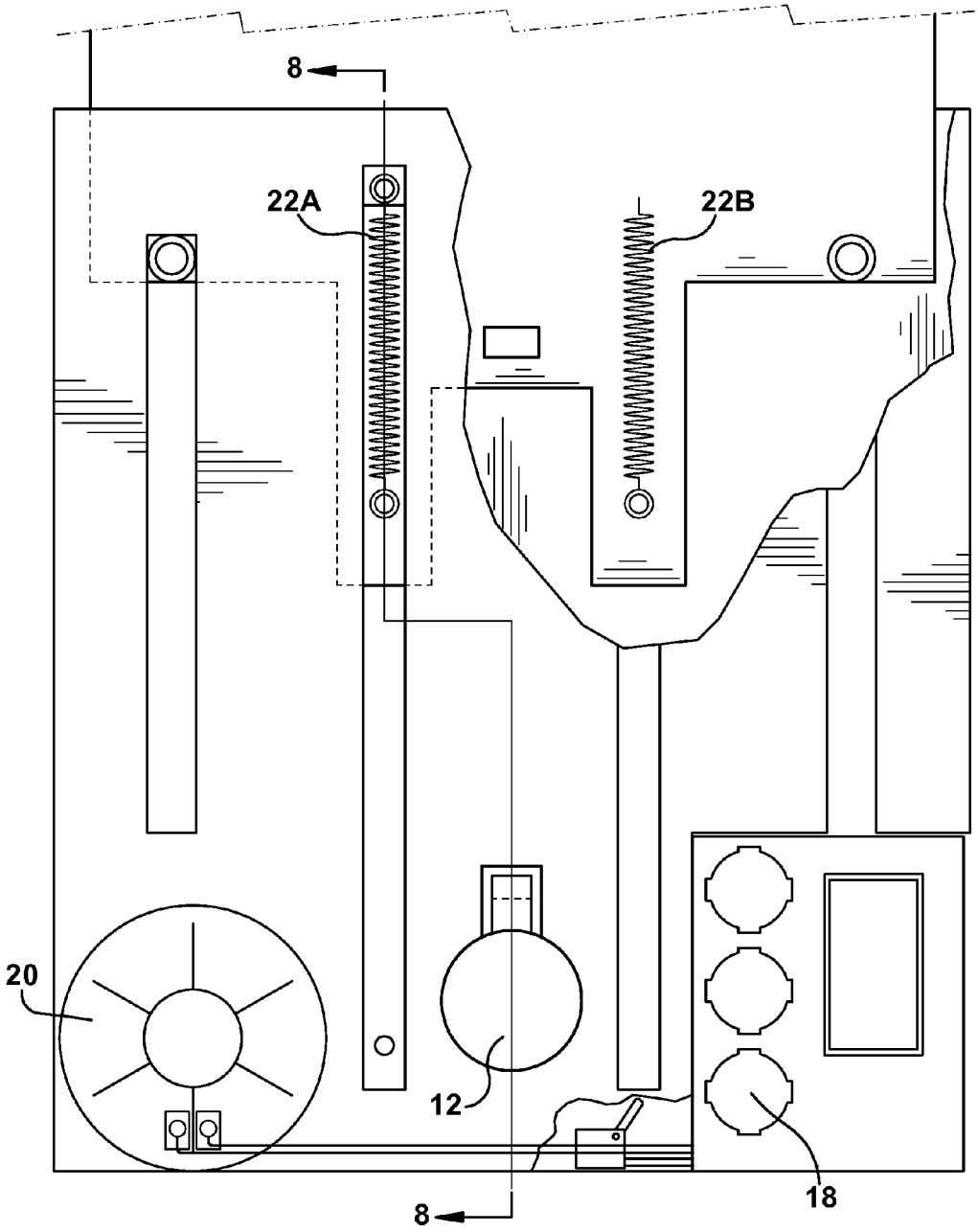
FIG. 4 is a front view of the internal components of the Pop-Up Greeting Card of FIG. 2.
Figure 5:
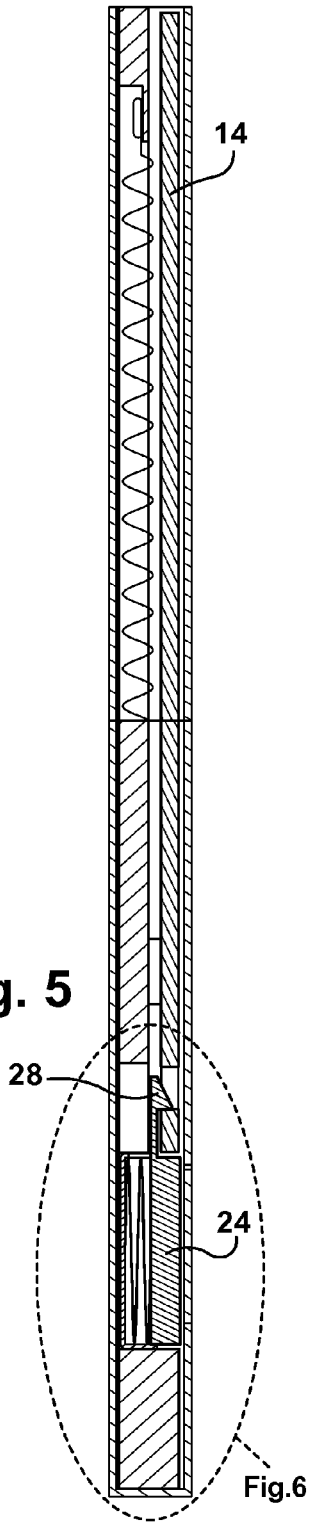
FIG. 5 is a cross-section of FIG. 3, viewed in the direction of arrows 5-5.
Figure 6:
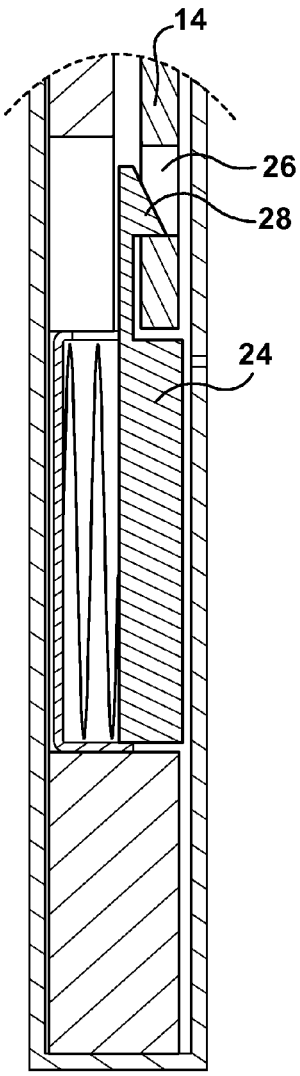
FIG. 6 is a close up view of a portion of FIG. 5.
Figure 7:
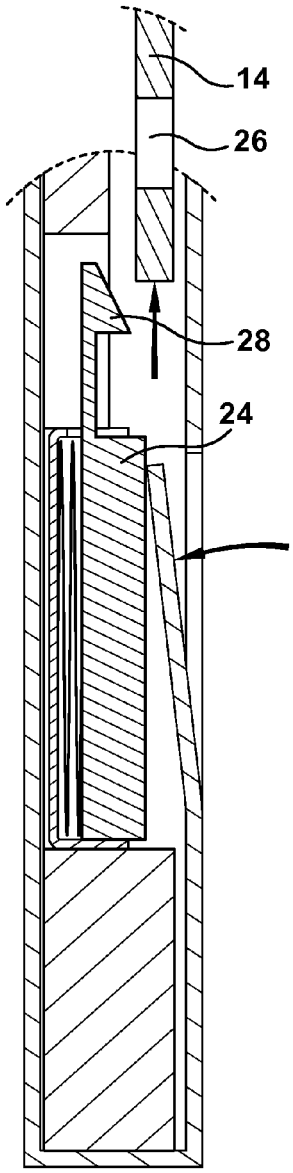
FIG. 7 is a close up view of a portion of FIG. 8.
Figure 8:
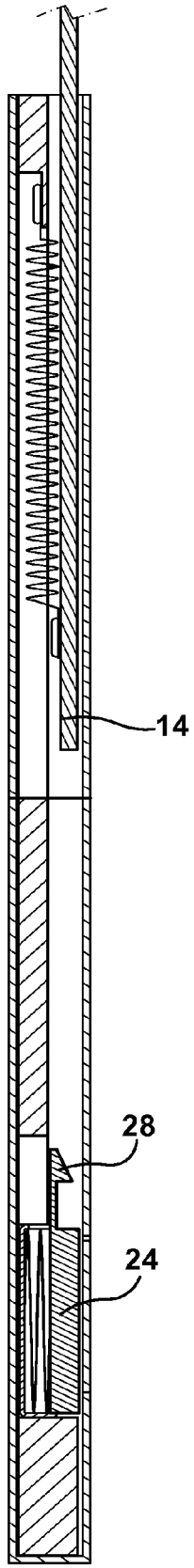
FIG. 8 is a cross-section of FIG. 4, viewed in the direction of arrows 8-8.

In one embodiment, shown in FIGS. 1 and 2, the greeting card body 10 has a front surface, a back surface parallel to and spaced apart from the front surface, and right, left and bottom side walls which extend between the front and back surfaces of the greeting card 100, creating a three sided pocket or cavity contained therein. A top edge 10E of the greeting card 100 is opened to accommodate the insertion and retraction of a pop-up element 14. The pocket or cavity is created by the three sided enclosure which, in a preferred embodiment is made of paperboard or other strong but lightweight material. Inside the pocket or cavity is contained a protective cardboard frame 16 for housing or accommodating electronic components, a push button 12 and spring activation mechanism or other activation mechanism, and a pop-up element 14. For example, the frame 16 can be made from one or more pieces of paperboard with appropriate cut-outs or openings which can be positioned between the front and back panels of the card to hold and secure the mechanical and electronic components of the card. The frame 16 contains a front panel and a back panel, both panels having various slots or openings strategically placed thereon to accommodate the various components of the greeting card 100. The front panel is parallel to and spaced apart from the back panel. In the space between the front and back panels are contained various components of the greeting card 100. In areas where no components are located, a piece of foam, cardboard, paperboard or other material may be used between the two panels to keep a consistent space between the panels. The electronic components may include a circuit board with integrated circuit and controller, memory storage device upon which at least one digital audio file is pre-loaded and saved, a power source, such as one or more batteries 18, a speaker 20, related circuitry and any other electronic component which may be required to store and replay one or more audio files, as are known to one with skill in the art. The pop-up element 14, in this particular embodiment, is a decorated panel having printed text, such as a birthday greeting and/or drawings or artwork contained thereon. The panel 14 is positioned between the front and back panels of the protective frame 16. The spring loaded mechanism includes two springs 22A, 22B which are attached at a first end to the bottom of the pop-up element or panel 14 and at a second end to an upper region of the protective frame 16. When the pop-up element 14 is in a first position substantially concealed within the greeting card, as shown in FIG. 1, the springs are stretched out, as shown in FIG. 3. A push button mechanism is contained between the protective panels 16 and contains a push button 12 that is connected to a catch or an arm 24. The catch or arm 24 of the push button mechanism contains a lip 28 that extends outward in a forward direction. The pop-up element or inner panel 14 contains a small opening 26 thereon so that when the pop up element 14 is in a first position substantially concealed within the greeting card 100, i.e., between the front and back panels of the card and within or proximate to the frame, the lip 28 of the catch or arm 24 extends into the opening 26 on the pop-up element or inner panel 14, thereby retaining the panel 14 within the greeting card 100 with the springs 22A, 22B in an extended or stretched position, as shown in FIGS. 3, 5 and 6. When the push button 12 is depressed it moves the catch or arm 24 causing the lip to become disengaged with the opening 26 on the pop-up element 14, releasing the springs 22A, 22B, as shown in FIGS. 4, 7 and 8. The mechanical energy stored in the springs 22A, 22B when they are in an extended or stretched state, propel or eject the pop-up element 14 upward through the opening along the upper edge 10E of the greeting card body 10. In addition to causing the pop-up element 14 to be revealed through the top of the greeting card 100, the press button 12 also initiates playback of the at least one pre-loaded audio file. The audio file may contain a spoken message, a song, music, various sounds, etc. When the pop-up element 14 is pushed back down and secured inside the greeting card 100, playback of the audio ends.

Figure 9:
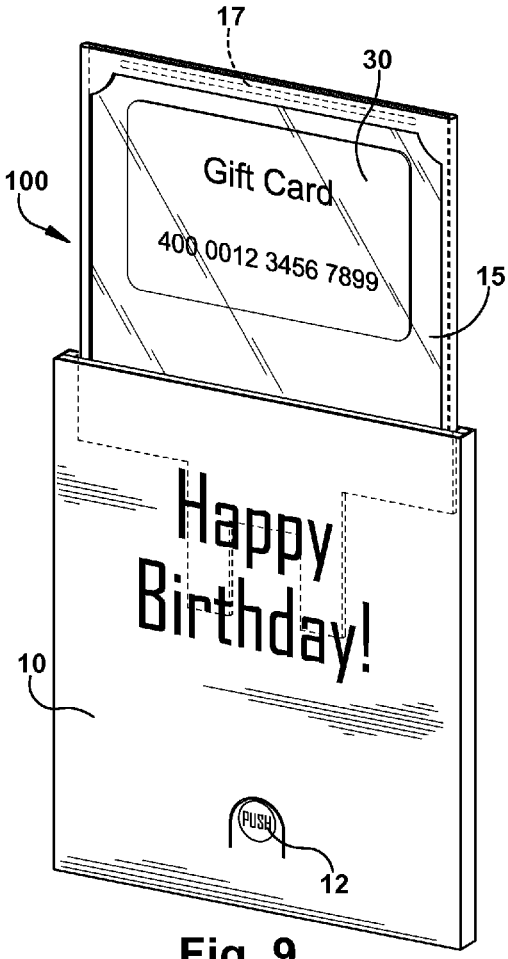
FIG. 9 is an alternate embodiment of the Pop-Up Greeting Card of the present invention.
Figure 11:
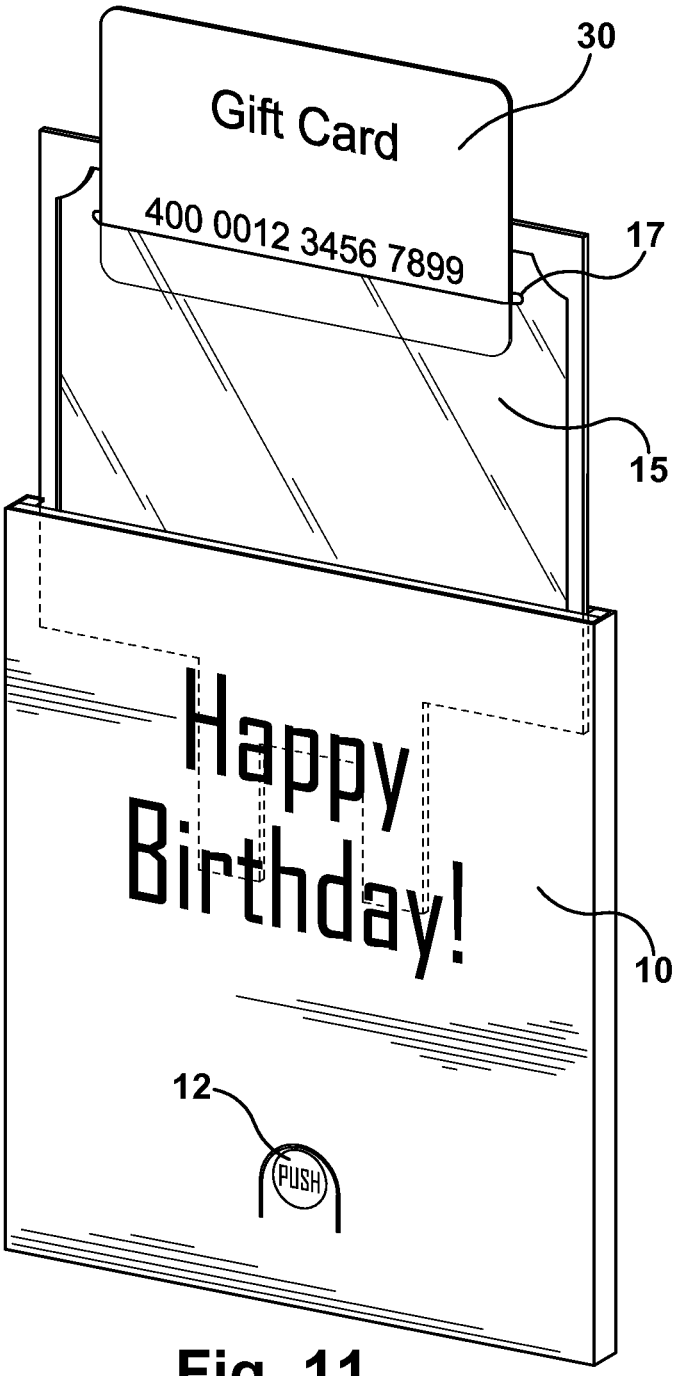
FIG. 11 is a perspective view of the Pop-Up Greeting Card of FIG. 9 with a gift card partially removed from a cavity.

In an alternate embodiment, shown in FIGS. 9 and 11, the greeting card of the present invention includes a pop-up element 15 which serves as a pocket or cavity wherein a gift card 30 may be inserted for presentation to the greeting card recipient. The greeting card body 10 may include, as described above, a main pocket or cavity which contains a front side, a back side which is parallel and spaced apart from the front side, and a right, back and bottom side which extend between the front and back panels along three side edges, thereby creating a three-sided pocket. The top of the greeting card is open for inserting the pop-up element 15. The pop-up element 15 is in itself another pocket or cavity which is operative to contain a standard sized gift card 30. The pop-up cavity 15 may contain a front surface which contains an opening thereon through which the gift card 30 is visible, or the pop-up cavity 15 may contain a front surface which contains an opening thereon which is covered with acetate or other clear, transparent material, through which the gift card 30 is visible. Alternatively the entire pop-up cavity 15 may be made of acetate or other clear, transparent material. The pop-up cavity 15 may be closed on all sides to prevent accidental removal of the gift card, with a slot 17 or flap or tab removably attached along a top surface which can be used to open the cavity 15 and remove the gift card 30. The cavity 15 may also be a three-sided cavity with a completely open top edge for removal of the gift card 30. The pop-up cavity 15 is larger than the measurements of a standard gift card, which are approximately 5¼ inches high and 3⅝ inches wide. Alternatively, the pop-up element may be a single panel, as described above, with a gift card 30 removably attached thereto. The spring and push button mechanism described above, may be used to move the pop-up cavity 15 (with gift card 30 therein) between a first position wherein the pop-up cavity 15 is substantially concealed within the main greeting card pocket or cavity and a second position wherein the pop-up cavity 15 is substantially outside of the main greeting card pocket or cavity. The protective frame construct, also described above, may also be used in this embodiment to protect the various inner components of the greeting card 100. This embodiment may also include a sound module contained within the main pocket or cavity which is operative to store and playback at least one pre-recorded audio file.

Figure 10:
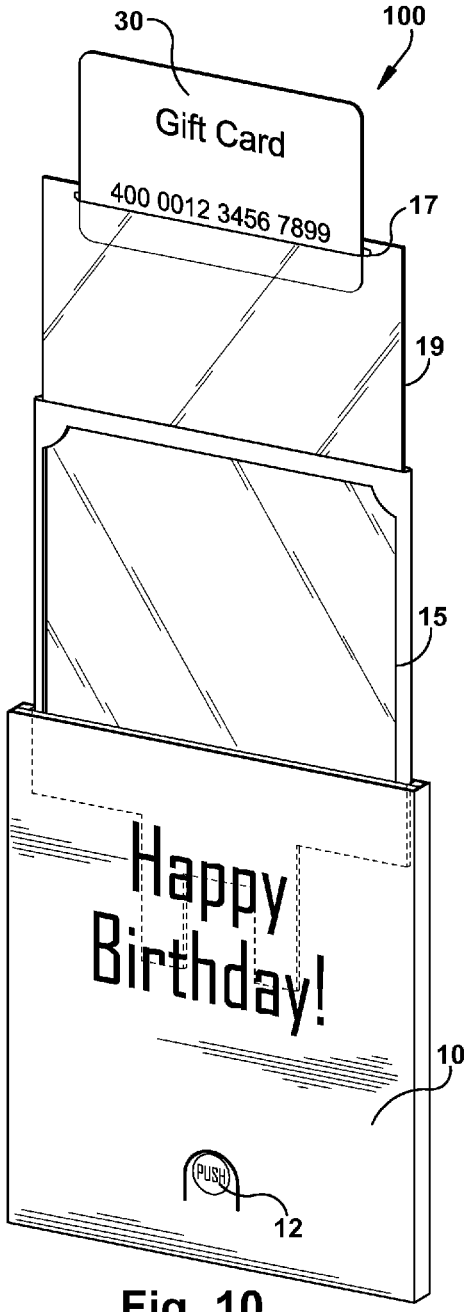
FIG. 10 is an alternate embodiment of the Pop-Up Greeting Card of the present invention.

In still another embodiment, shown in FIG. 10 the greeting card 100 includes two or more telescoping pockets or panels 19 which telescope in an inward and outward direction with respect to one another. The smallest or innermost pocket may contain a gift card 30 therein or removably attached thereto. Alternately, the gift card 30 may be configured to fit within the smallest or innermost pocket 19 and it may be ejected from said pocket 19 upon pushing the press button 12. The first or main pocket or cavity 10 serves as the outer surface of the greeting card 100, as described above with reference to the other embodiments, and therefore is the largest of the pockets or panels of the greeting card 100. All of the other pockets or cavities 19 of the greeting card 100 are sized to fit within the first or main pocket 10 of the greeting card 100. After the first or main pocket 10, each successive pocket or cavity 19 is slightly smaller in size than the previous pocket or cavity such that each successive pocket or cavity 19 fits within the previous pocket. The main pocket or cavity 10, as described above, may have a front side, a back side parallel to and spaced apart from the front side and right, left and bottom sides which extend between the front and back panels along three side edges of the main panel or cavity. The spring and push button mechanism described above with respect to the other embodiments can be used to move the two or more inner pockets or cavities from a first position wherein the inner pockets or cavities are substantially contained and concealed within the main pocket or cavity and a second position, wherein the two or more inner pockets or cavities are substantially outside of the main pocket or cavity. The protective frame described above may also be used with this embodiment to protect the various internal components of the greeting card. This embodiment may also contain a sound module, as described above, which is operative to replay a pre-recorded audio file upon pressing the press button. Alternatively, instead of a gift card, the pocket or pockets may contain a smaller greeting card, small token gift or other novelty which can be fit within one or more of the inner pockets.

In yet another embodiment, shown in FIGS. 12-16, the greeting card described herein combines a spring loaded pop-up element which contains confetti which is ejected or dispersed when the user activates a switch mechanism, which in a preferred embodiment, is a press button switch. The switch may also activate sound simultaneously with ejecting the confetti. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity while scattering confetti around the area of the greeting card.

Figure 12:
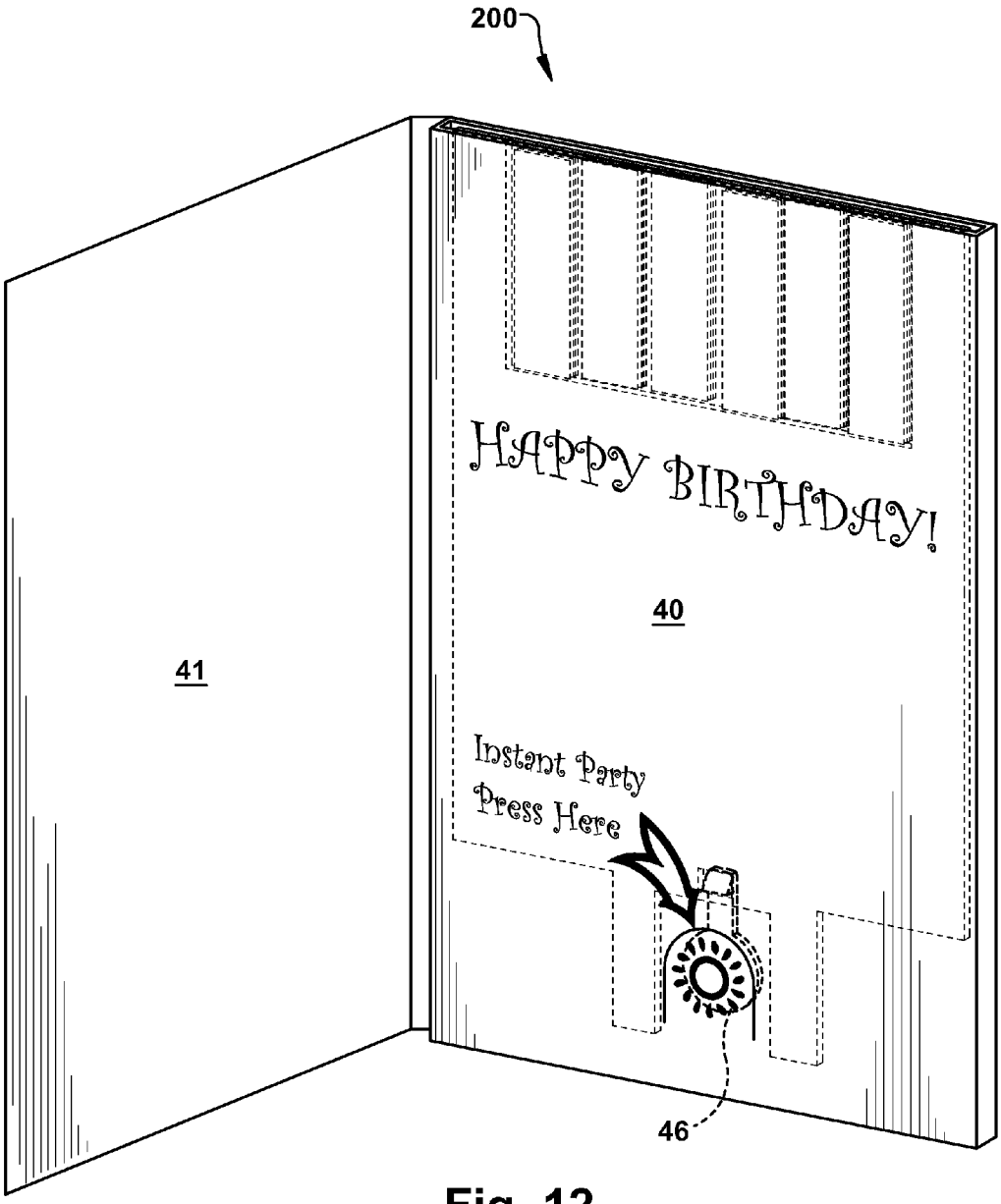
FIG. 12 is a perspective view of an alternate embodiment of the Pop-Up Greeting Card of the present invention.
Figure 13:
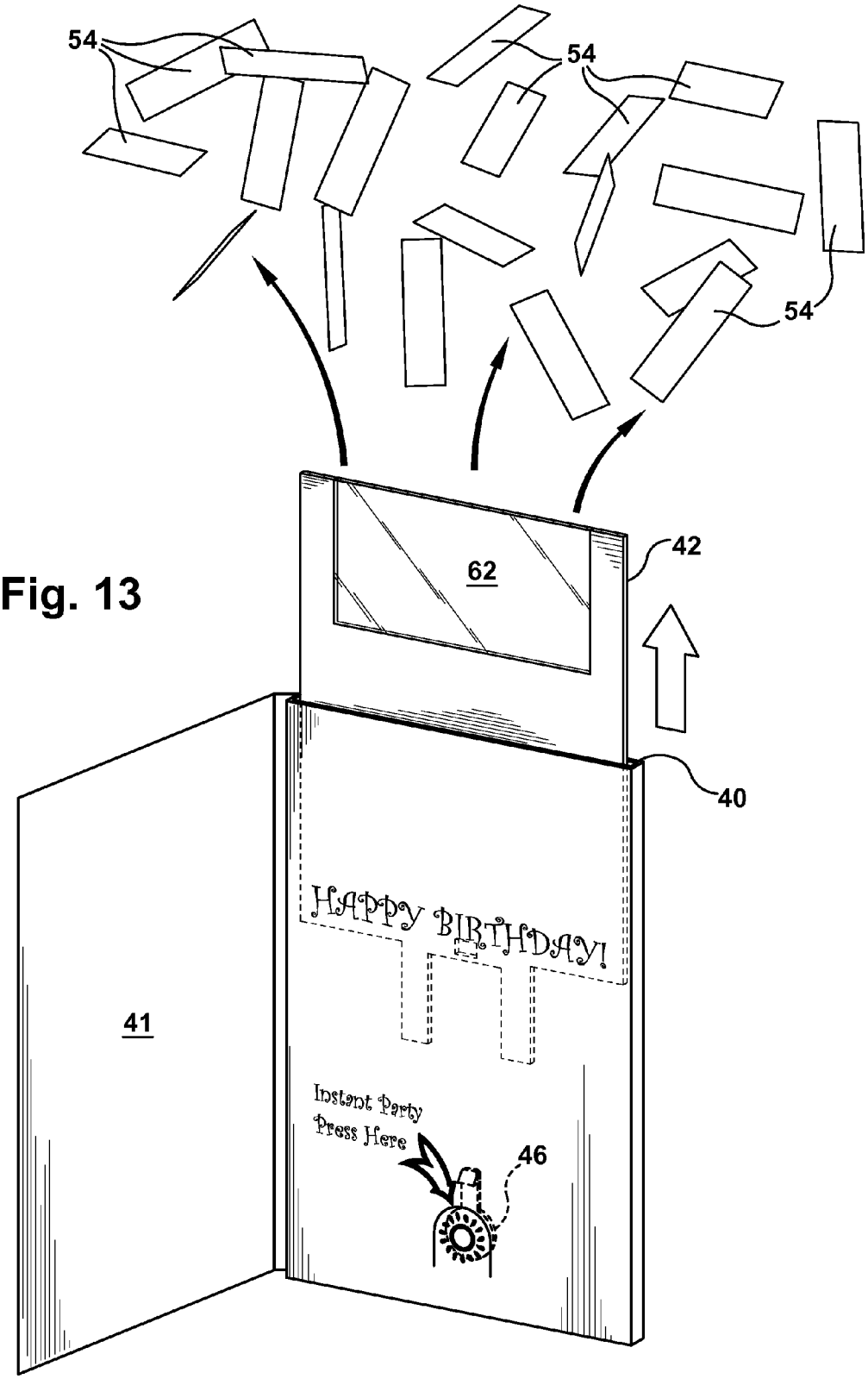
FIG. 13 is a perspective view of the Pop-Up Greeting Card of FIG. 12, with ejected panel and confetti.

In this embodiment, the greeting card body contains a pocket 40 which has a front surface, a back surface parallel to and spaced apart from the front surface, and a right, left and bottom side wall which extend between the front and back surfaces of the greeting card, creating the three sided pocket or cavity. A top edge of the pocket 40 is opened to accommodate the insertion and retraction of a pop-up, confetti-retaining element 42. The pocket or cavity 40, in a preferred embodiment, is made of paperboard or other strong but lightweight material. Inside the pocket or cavity 40 is contained a protective cardboard frame for housing 44 or accommodating electronic components, a push button 46 and spring activation mechanism or other activation mechanism, and a pop-up element 42. For example, the frame 44 can be made from one or more pieces of paperboard with appropriate cut-outs or openings can be positioned between the front and back panels of the pocket 40 to hold and secure the mechanical and electronic components of the card. The frame 44 various slots or openings strategically placed thereon to accommodate the various components of the greeting card. In areas where no components are located, a piece of foam, cardboard, paperboard or other material may be used to keep a consistent space between the front and back panels of the frame 44. The pocket 40 may be wrapped, at least partially, by paperboard (or other material) cover 41 which is divided into panels sectioned by fold lines. The paperboard cover 41 extends over the back surface, left side wall and front surface of the pocket 40. The cover 41 may be attached, adhesively or otherwise, to the back surface of the pocket 40. The portion of the cover 41 which extends over the left side wall and the front surface of the pocket 40 is not physically attached to the pocket 40 but merely wraps around the pocket to serve as the front cover and left inside panel of the greeting card 200, as shown in FIG. 12. Alternately, the portion of the cover 41 which extends over the left side wall of the pocket 40 may be attached thereto, adhesively, or otherwise.

The electronic components of the greeting card may include a circuit board 48 with integrated circuit and controller, memory storage device upon which at least one digital audio file is pre-loaded and saved, a power source 50, such as one or more batteries, a speaker 52, related circuitry and any other electronic component which may be required to store and replay one or more audio files, as are known to one with skill in the art.

Figure 14:
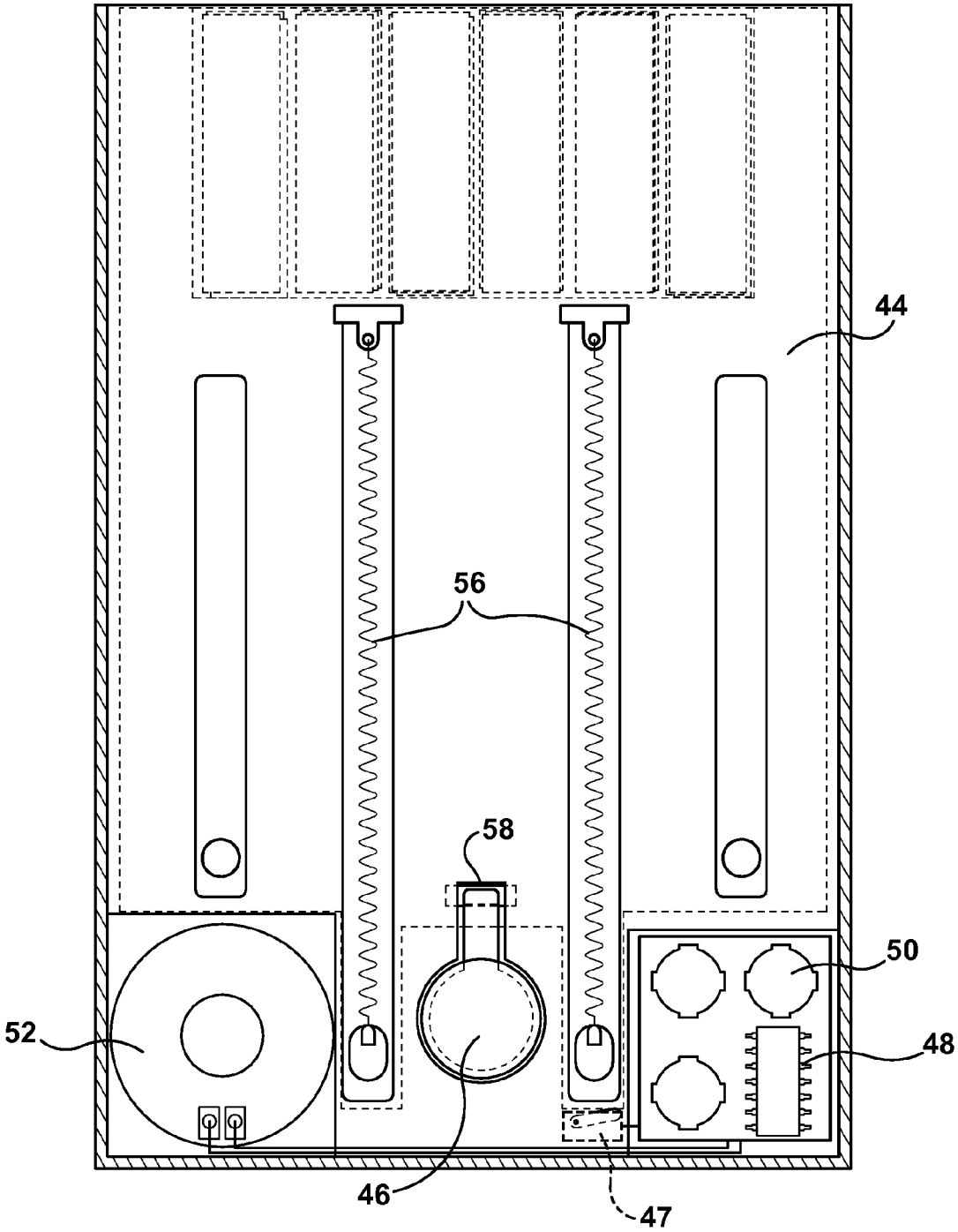
FIG. 14 is a front view of the internal components of the Pop-Up Greeting Card of FIG. 12.
Figure 15:
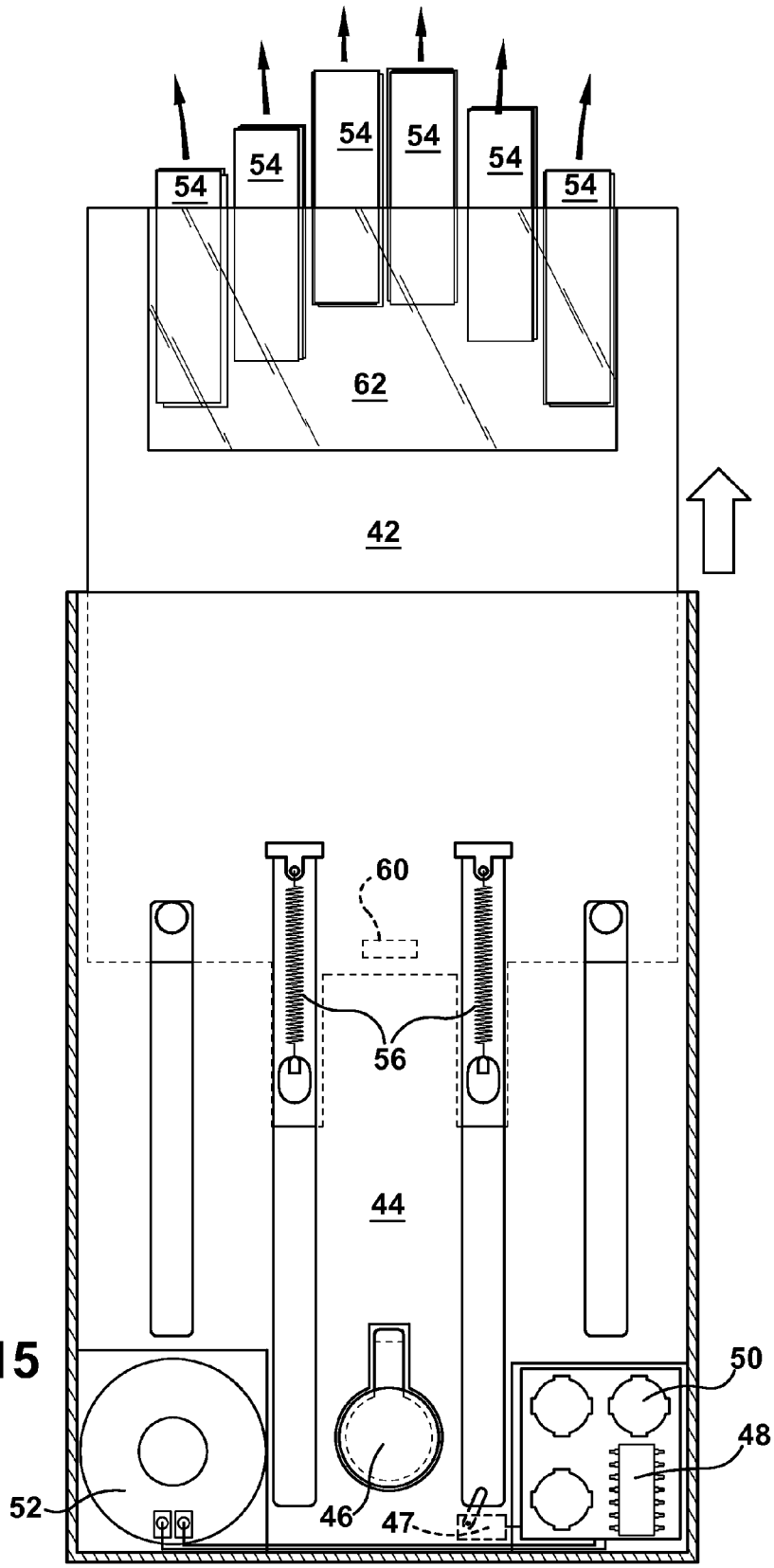
FIG. 15 is a front view of the internal components of the Pop-Up Greeting Card of FIG. 12, with ejected panel and confetti.
Figure 16:
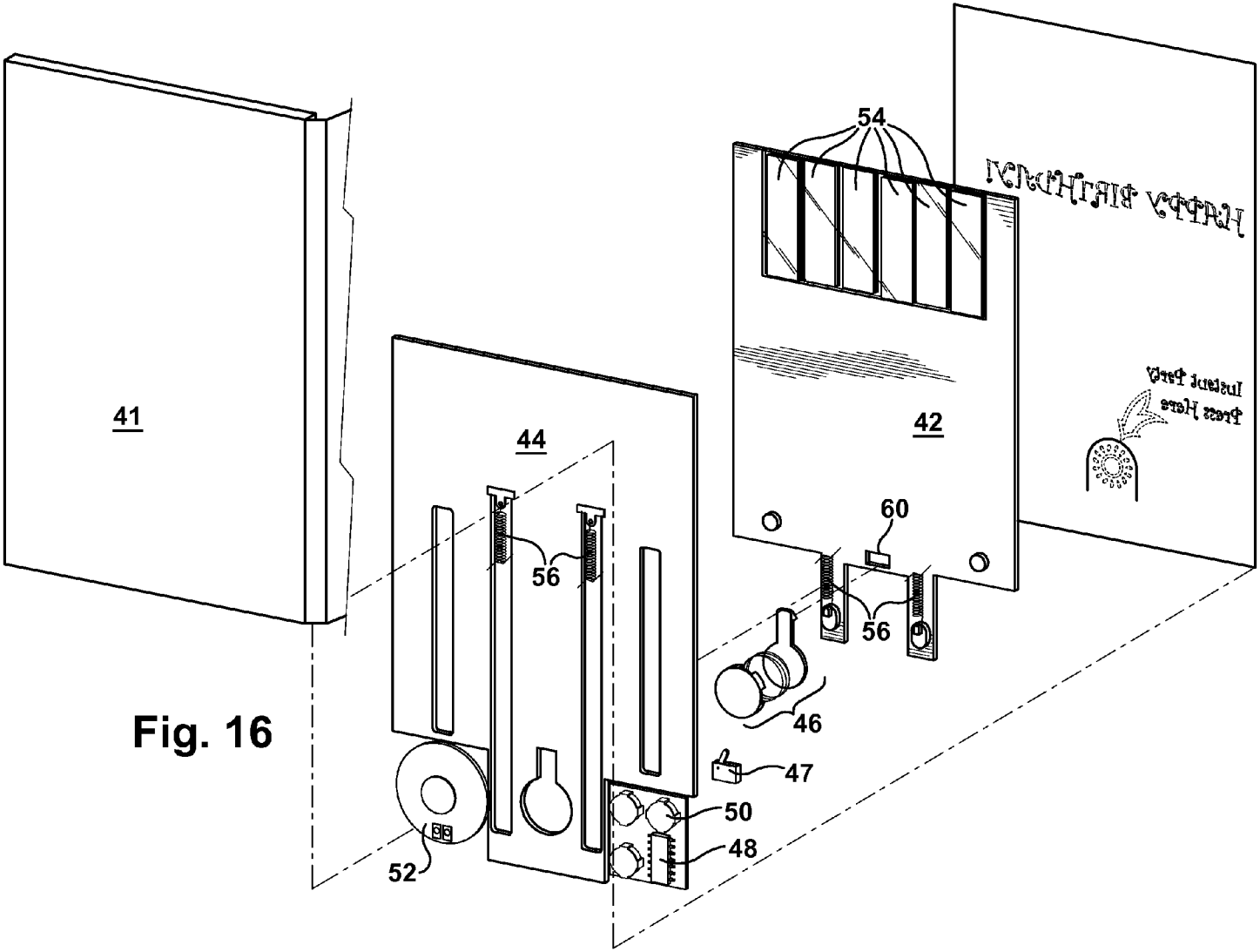
FIG. 16 is an exploded view of the Pop-Up Greeting Card of FIG. 12.
Figures 17, 18:
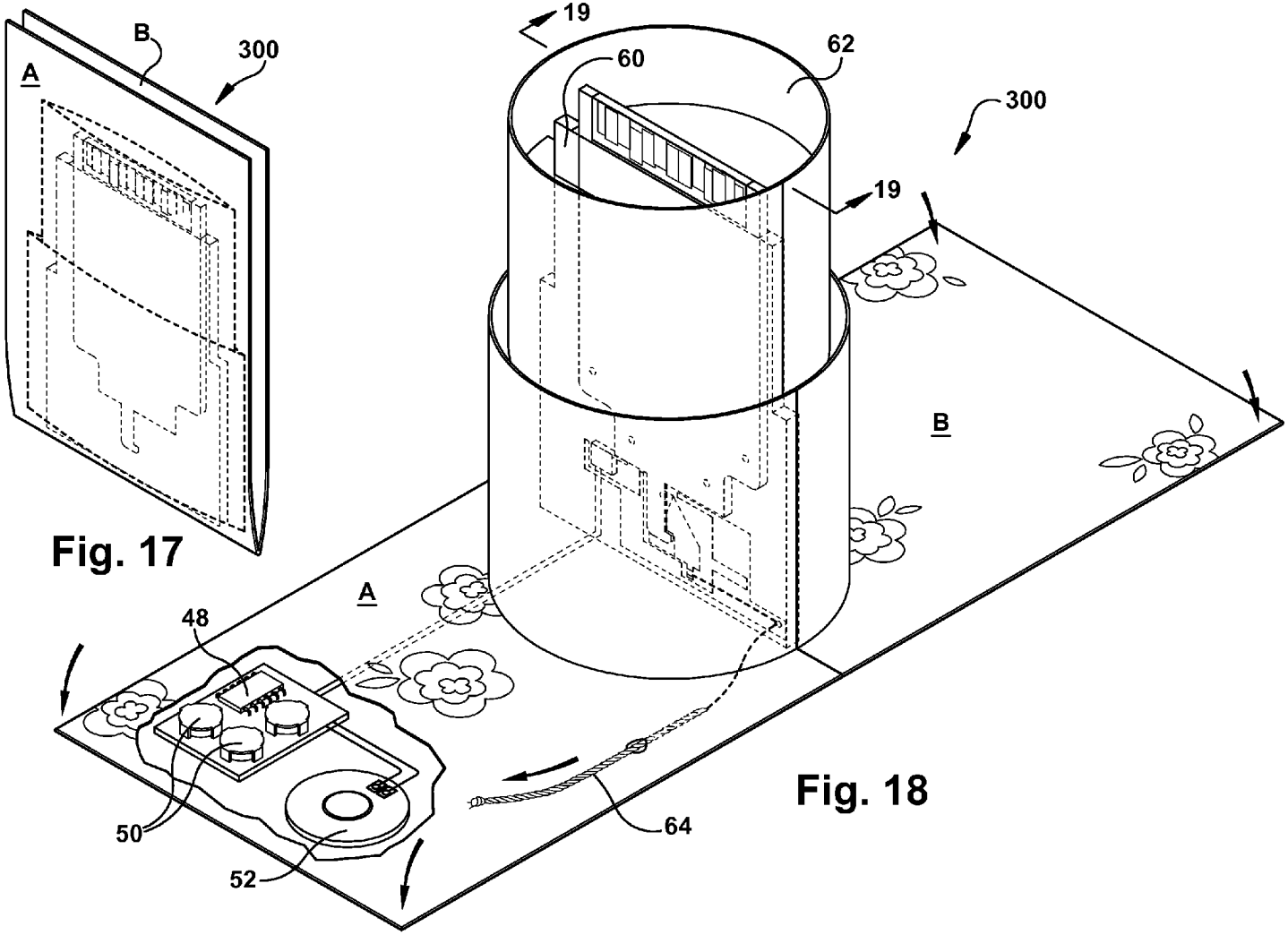
FIG. 17 is a perspective view of an alternate embodiment of the Pop-Up Greeting Card of the present invention, in a closed position.
FIG. 18 is a perspective view of the Pop-Up Greeting Card of FIG. 17, in an opened position.
Figure 19:
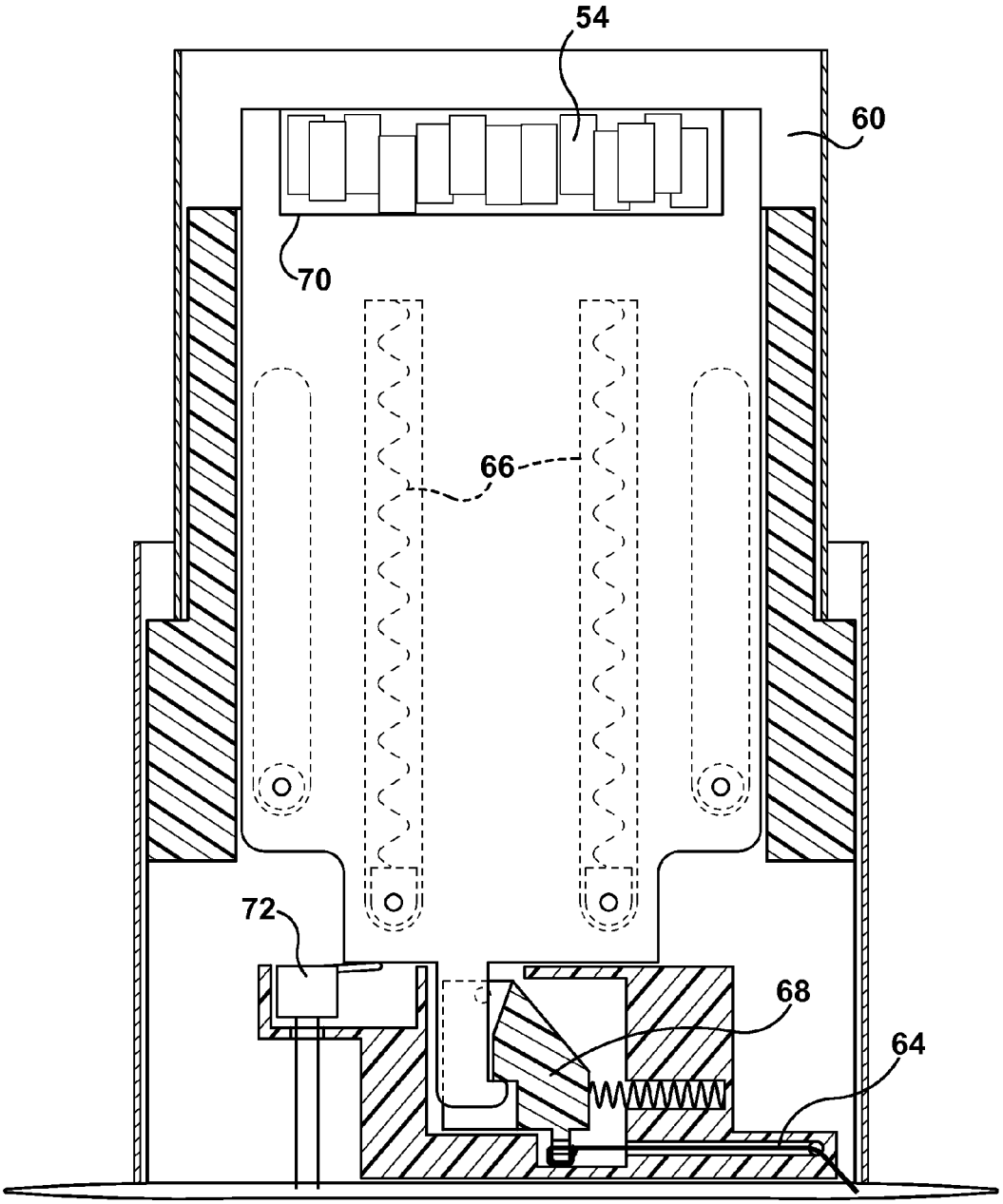
FIG. 19 is a cross-sectional view of the internal structure of the Pop-Up Greeting Card of FIG. 17, in a non-released position.

The pop-up element 42, in this particular embodiment, is a narrow cavity or compartment having a front panel and a back panel which contain the confetti 54 therebetween. The front and back panels of the pop-up element 42 may have printed text, such as a birthday greeting and/or drawings or artwork contained thereon. The pop-up element 42 is positioned between the front and back panels of the protective frame 44. The spring loaded mechanism includes two springs 56 which are attached at a first end to the bottom of the pop-up element 42 and at a second end to an upper region of the protective frame 44. When the pop-up element 42 is in a first position substantially concealed within the greeting card, the springs are compressed or stretched. A push button mechanism is contained between the protective panels 44 and contains a push button 46 that is connected to a catch or an arm 58. Words may be printed on the greeting card directing the user to the push button 46. For example, the printing may say something like "instant party, press here". The catch or arm 58 of the push button mechanism 46 contains a lip that extends outward in a forward direction. The pop-up element or inner compartment 42 contains a small opening thereon 60 so that when the pop up element 42 is in a first position substantially concealed within the greeting card, i.e., between the front and back panels of the pocket 40 and within or proximate to the frame 44, the lip of the catch or arm 58 extends into the opening 60 on the pop-up element 42, thereby retaining the pop-up element 42 within the pocket 40 with the springs 56 in an extended position, as shown in FIG. 14. When the push button 46 is depressed it moves the catch or arm 58 causing the lip to become disengaged with the opening 60 on the pop-up element 42 and releasing the extended or stretched springs 56. The mechanical energy stored in the springs 56 when they are in a stretched state, propel or eject the pop-up element 42 upward through the opening along the upper edge of the pocket 40 while releasing the confetti 54. The confetti 54 may be a plurality of strands or bits of paper, small die cut shapes, or any other small, flat, lightweight, paper-like substance. The term confetti also covers streamers, paper discs, spiders, or any other small lightweight item that can be dispersed from the pop-up element 42. The confetti 54 is ejected along with the inner compartment 42 which houses the confetti 54 and then floats to the ground. Prior to purchasing the greeting card at retail, the inner compartment 42 which contains the confetti 54 may have an overlying transparent plastic sheet or wrapping 62 to allow consumers to test the card at retail by pressing the button 46 and having the pop-up element or inner compartment 42 appear. A sticker or other mild adhesive may be used to attach the transparent plastic sheet or cover 62 to the pop-up element 42. Once a consumer purchases the card, he/she may remove the sticker and the plastic sheet 62 before placing the card 200 in the envelope for presentation to the recipient. In addition to causing the pop-up element 42 to be revealed through the top of the greeting card 200 and releasing the confetti 54, the press button 46 also initiates playback of the at least one pre-loaded audio file. The audio is triggered by a small trigger mechanism 47, which contains a lever that is held in place by one of the spring elements 56. The lever pivots about the trigger mechanism 47. When the pop-up-element 42 (to which the spring mechanism 56 is attached) is in the first position, wherein it is contained within the pocket 40, the spring element 56 holds the lever on the trigger mechanism 47 in a first positon, as shown in FIG. 14. When the press button 46 is depressed, moving the pop-up element 42 from the first position to a second position, wherein the pop-up element 42 is substantially outside of the pocket 40, the lever is released, allowing it pivot away from the trigger mechanism 47 (as shown in FIG. 15) and allowing the circuit to be completed, thereby initiating playback of at least one audio file. The audio file may contain a spoken message, a song, music, various sounds, etc. When the pop-up element 42 is pushed back down and secured inside the pocket 40, playback of the audio ends. The next time the push button 46 is depressed, the pop-up element 42 will still be ejected from the greeting card 200 but without the confetti 54 that was used on the first push of the button. In another embodiment, the greeting card may be packaged with additional confetti that may be paced by hand inside the greeting card or the envelope.

In still another embodiment, the greeting card of the present invention combines the embodiments shown in FIGS. 9-11 with the embodiment shown in FIGS. 12-16. The pop-up element contains a pocket, as described above with respect to FIGS. 9 and 11, or two or more telescoping pockets or panels, as described above with respect to FIG. 10. The pop-up element also contains confetti, as described above with respect to FIGS. 12-16. This embodiment provides the surprise of the pop-up element and confetti while serving as a carrier or gift card holder. In one embodiment, the gift card is contained within one of the pockets, as described above, or the gift card may be removably attached to the front surface of the pop-up panel while the confetti is dispersed from the inside of the pop-up panel, as described above. In another embodiment, the gift card may be removably attached to the greeting card body, instead of the pop-up panel or cavity.

Figure 20:
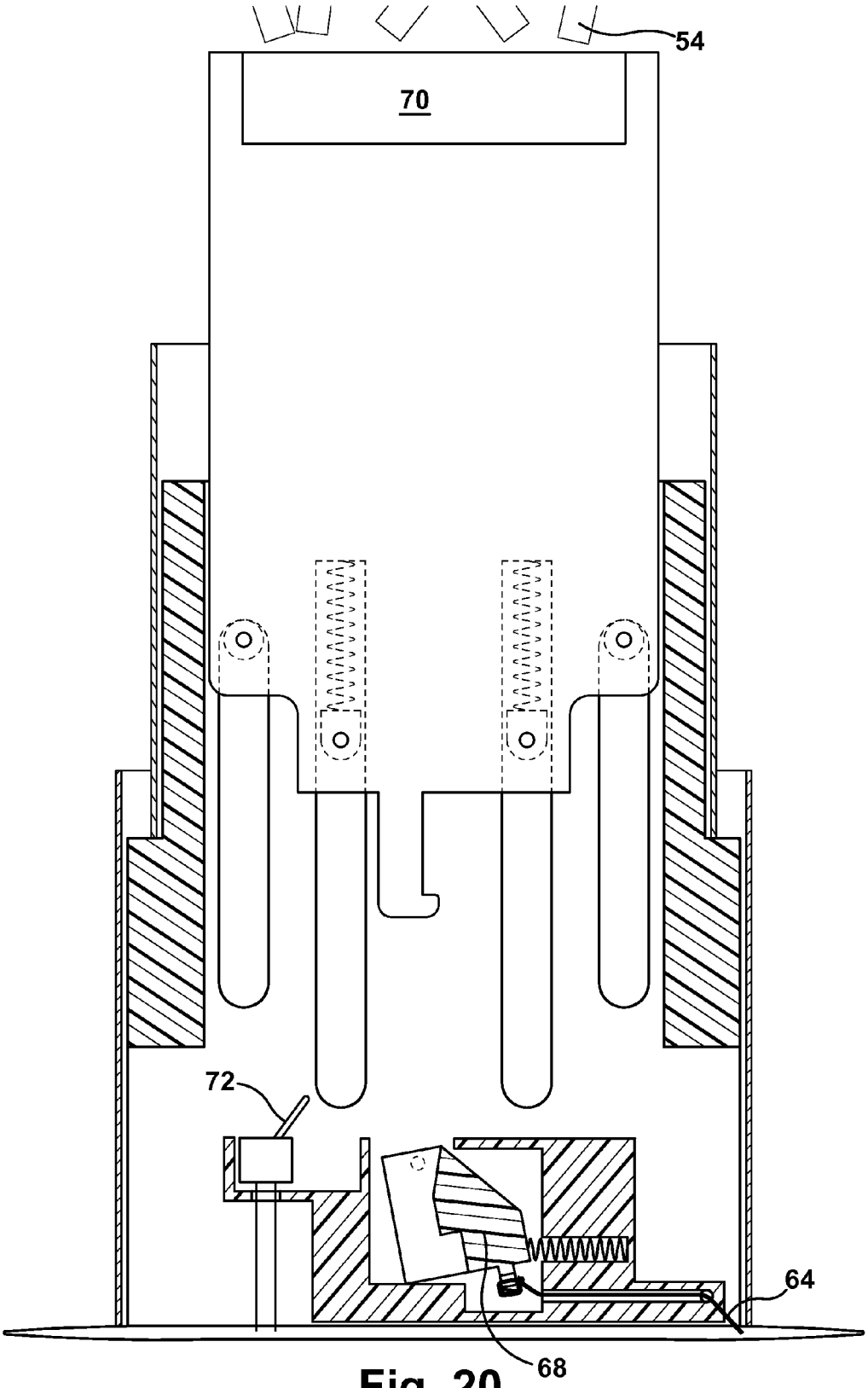
FIG. 20 is a cross sectional view of the internal structure of the Pop-Up Greeting Card of FIG. 17, in a released position.

In still another embodiment, shown in FIGS. 17 through 20, the greeting card of the present invention may include a pop-up element 60 contained within a three dimensional pop-up structure 62 which is located between two panels A, B of the greeting card 300. The three-dimensional pop-up structure 62 and the pop-up element 60 contained therein may together be moveable between a first position (shown in FIG. 17), wherein the pop-up structure 62 is folded into a substantially flat, folded configuration between two greeting card panels A, B and a second positon (shown in FIG. 18), wherein the pop-up structure 62 is unfolded to be a fully upright pop-up structure 62. The pop-up structure 62 moves between the first and second positons by closing (first position) and opening (second position) the greeting card 300. Confetti 54, as described above, can be contained within the pop-up element 60 such that when the greeting card 300 is moved to an open position wherein the pop-up structure 62 (with pop-up element 60 contained therein) is unfolded, confetti 54 is released through an opening in the three-dimensional pop-up structure 62. The three-dimensional pop-up structure 62 may be formed into a structure which complements the theme and/or artwork of the greeting card. The confetti 54 contained therein may also take on a particular size, shape and color which is complementary to the overall theme of the greeting card 300. For example, the pop up structure 62 may be shaped like a box of popcorn, and when the greeting card 300 is opened and the popcorn box is unfolded, confetti 54 is released from within the structure 62 which resembles popcorn. Another example may have the pop-up structure 62 as a can and the confetti 54 shaped like snakes or a pop-up structure 62 as a tornado with confetti 54 shaped like sharks. The pop-up structure 62 and confetti 54 can take on a variety of different shapes, sizes and may be made from a variety of materials. The greeting card 300 may be operative to release the confetti 54 upon opening the greeting card 300, as described above, or it may have alternative trigger methods such as a pull string 64, push button, light sensor, touch sensor, magnetic trigger, or any other such mechanism. For example, the embodiment shown in FIGS. 17 through 20 contains a two-tiered, cylindrical pop-up structure 62 which is in the shape of a cake. Once the greeting card 300 is in an open position and the pop-up structure 62 is unfolded into a full, upright position, a string 64 can be pulled by the user to eject the confetti 54 from the within the pop-up element 60 through the top of the pop-up structure (cake) 62. One end of the pull string 64 is connected to the pop-up element 60 located inside the pop-up structure 62, and the other, opposite end of the pull string 64 exits from beneath the pop-up structure 62 to be visible to the user between the two panels A, B of the greeting card 300. The top surface of the cylindrical pop-up structure 62 is open so that the confetti 54 is free to exit the pop-up element 60 and be dispersed through the top of the pop-up structure 62. The confetti 54 may be dispersed only upon the first opening of the greeting card 300 or it may have an opening thereon, through which additional confetti 54 may be inserted for release upon subsequent openings of the greeting card 300. Similar to the pop-up element 60 described above with respect to the other embodiments of the greeting card, the pop-up element 60 of this greeting card 300 is a narrow cavity or compartment having a front panel and a back panel opposite the front panel with the confetti 54 contained therebetween. The front and back panels of the pop-up element 60 may have printed text, drawings, artwork or other indicia printed thereon. The pop-up element 60 is positioned in the center of the three-dimensional pop-up structure 62. A spring loaded mechanism, which facilitates ejection of the confetti 54 from within the pop-up element 60, includes two springs 66 which are attached at a first end to the pop-up element 60 and at a second end to a protective frame which surrounds the pop-up element 60 within the pop-up structure 62. When the pop-up element 60 is in the first position, wherein it is fully or at least substantially contained within the pop-up structure 62, the springs are compressed. The pull string 64 is attached to a lever 68 which releases the springs 66 on the pop-up element 60, thereby ejecting the pop-up element 60 from within the three-dimensional pop-up structure 62 and into the second position, wherein the pop-up element 60 is substantially outside of the pop-up structure 62. As described above with respect to the other embodiments, the confetti 54 may be a plurality of strands or bits of paper, small die cut shapes, or any other small, lightweight substance. The term confetti also covers streamers, paper discs, or any other item which can be stored in and dispersed from the pop-up element 60. A small, inner compartment 70 within the pop-up element 60 houses the confetti 54. Prior to purchasing the greeting card 300 at retail, the inner compartment 70 which contains the confetti 54 may have an overlying, transparent plastic sheet or wrapping 72 to allow consumers to test the card at retail by pulling the pull string 64 and having the pop-up element 60 emerge from the pop-up structure 62 without releasing the confetti 54. A sticker or other mild adhesive may be used to attach the transparent sheet or cover 72 to the pop-up element 60. Once a consumer has purchased the greeting card 300, he/she may remove the sticker and the sheet 72 before placing the greeting card 300 into an envelope for presentation to the recipient. Alternatively, a confetti release mechanism may contain a lock mechanism which prevents the release of confetti upon opening the greeting card until the lock mechanism has been opened or released. In addition to causing the pop-up element 60 to be revealed through the top of the pop-up structure 62 and releasing the confetti 54, the pull string 64 may also initiate playback of at least one audio file. The audio is triggered by a small trigger mechanism 72, which contains a lever that is held in place by one of the spring elements 66 or by the pop-up element 60 itself. The lever pivots about the trigger mechanism 72. When the pop-up element 60 is in the first position, wherein it is fully or at least partially contained within the three-dimensional pop-up structure 62, the spring element 66 or pop-up element 60 hold the lever on the trigger 72 in a first position (shown in FIG. 19). When the pull string 64 has been pulled, moving the pop-up element 60 into the second position, wherein it is substantially contained outside of the three-dimensional pop-up structure 62, the lever is released, allowing it to pivot away from the trigger mechanism 72 (as shown in FIG. 20) and completing a circuit, thereby initiating playback of at least one audio file. The audio file may contain a spoken message, a song, music, various sounds, etc. When the pop-up element 60 is pushed back down and secured inside the three-dimensional pop-up structure 62, playback of the audio ends. The next time the pull string 64 is pulled, the pop-up element 60 will still be ejected from the pop-up structure 62 and trigger audio playback, however, confetti 54 will not be released. As mentioned above, in an alternate embodiment, the greeting card 300 may be packed with additional confetti 54 which can be re-loaded into the compartment 70 within the pop-up element 60 by hand for a subsequent confetti release. In another alternate embodiment, in addition to releasing confetti 54, this greeting card embodiment may also contain a small pocket or cavity which contains a gift card or other item, as described above with regard to the other embodiments. The pocket or cavity may be ejected or pushed upward from the top of the pop-up structure so the pocket or cavity is visible to the greeting card recipient. As described above with respect to the other embodiments, the pocket or cavity may be transparent so the existence of the gift card therein is immediately recognized. The pocket or cavity may have an opening thereon through which the gift card (or other object) can be inserted and removed. The gift card may be packaged and sold together with the greeting card or the greeting card may be sold with an empty pocket or cavity so that the gift card purchaser can select and purchase a gift card of his/her choice to place within the pocket or cavity of the greeting card.

While the embodiments disclosed herein and shown in the figures have a generally square or rectangular shape, the greeting card may take on any conceivable die cut shape. The greeting card may also be made of alternate material such as plastic or foam. Also, the greeting card has been described and shown as having a press button which is operative to move the inner greeting card panel(s) from within a main pocket to outside the main pocket, however, any type of switch, such as a touch sensitive switch, a slide tongue switch, a light sensitive switch, a motion sensitive switch, a hand crank, a lever or any other mechanical or electromechanical device may be used. Also, the press button switch described herein controls both the movement of the inner panel(s) and also playback of an audio file, however, two separate switches may control the movement of the panel(s) and the playback of audio.

All of the embodiments described herein may additionally contain a USB port, SD card slot or other external memory device port for receiving or uploading audio files from an external source such as a personal computer. The greeting card embodiments disclosed herein may also contain a sentiment panel which is attached to a front or back surface or side of the main pocket or panel and serves as a traditional greeting card that is folded along a fold line and opened along said fold line to reveal a message, artwork, etc. Other additional features which have been contemplated are a microphone for recording a personalized user message for playback upon activation of the press button or other such switch; a motor module for mechanical movement of one or more movable elements which are attached in some way to the greeting card; and one or more LED lights which are visible through the front of the greeting card and which are illuminated upon pressing the press button or other such switch. Combination of the above-mentioned additional special effects or features have also been contemplated and are considered to be within the scope of the present invention.

The disclosure and related inventions thus provide novel card constructions and operations which can be constructed inexpensively and efficiently, and advantageously from primarily paperboard materials configured to securely hold mechanical and electronic components to enable a wide variety of functions and features which enhance the effectiveness of the card as a communication and entertainment device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A greeting card comprising:

a greeting card body having two or more greeting card panels;

a pop-up structure contained between at least two greeting card panels, the pop-up structure capable of moving between a first position wherein it is in a substantially flat, fold position and a second position wherein it is unfolded into a three dimensional structure;

an inner compartment which is located inside of the pop-up structure operative to release confetti from the pop-up structure, when the pop-up structure is in the second positon, wherein the pop-up structure is a tiered substantially circular structure.

2. The greeting card of claim 1 further comprising a pull string operative to release the confetti from the pop-up structure.

3. The pop-up greeting card of claim 1 further comprising a gift card attached to the inner compartment.

4. The pop-up greeting card of claim 1 further comprising a sound module operative to store and replay audio.

5. The pop-up greeting card of claim 4, wherein the sound module initiates audio replay upon opening the greeting card.

6. The pop-up greeting card of claim 4, wherein the sound module initiate audio replay upon the release of confetti from the pop-up structure.

7. A pop-up greeting card comprising:

a greeting card body having at least two greeting card panels;

a three-dimensional pop-up structure located between the at least two greeting card panels, the three-dimensional pop-up structure operative to move between a substantially flat, folded position when the greeting card body is in a closed position and an unfolded, upright position when the greeting card body is in an open position;

an inner compartment contained within the three-dimensional pop-up structure, the inner compartment containing a plurality of confetti therein and operative to move between a first position wherein the inner compartment is at least substantially contained within the three-dimensional pop-up structure and a second position wherein the inner compartment is substantially contained outside of the three-dimensional pop-up structure;

a pull string which is attached to the inner compartment which controls the movement of the inner compartment from the first position to the second position and also controls the dispersement of the plurality of confetti from within the inner compartment out of a top of the three-dimensional pop-up structure.

8. The pop-up greeting card of claim 7 further comprising a sound module operative to store and playback at least one audio file.

9. The pop-up greeting card of claim 8, wherein the pull string also controls activation of the sound module.

10. The pop-up greeting card of claim 7 further comprising a removable cover material which is located over the inner compartment to prevent dispersing the plurality of confetti from the inner compartment upon pulling the pull string.

11. The pop-up greeting card of claim 7, wherein the inner compartment is attached to a spring loaded release mechanism to facilitate swift movement of the inner compartment between the first and second positions when the pull string is pulled.

12. The pop-up greeting card of claim 7, wherein the three-dimensional pop-up structure is substantially cylindrical shaped.

13. The pop-up greeting card of claim 7, wherein the inner compartment can be reloaded with confetti after the greeting card is opened for the first time.

14. A pop-up greeting card comprising:

a multi-panel greeting card body;

a three-dimensional pop-up structure contained within the multi-panel greeting card body;

a sound module operative to store and replay at least one audio file;

an inner compartment contained within the three-dimensional pop-up structure, the inner compartment having a plurality of confetti contained therein;

a trigger mechanism which controls the release of the plurality of confetti from within the inner compartment and replay of the at least one audio file.

15. The pop-up greeting card of claim 14, wherein the trigger mechanism is user-activated.

16. The pop-up greeting card of claim 14, wherein the three-dimensional pop-up structure is in a folded position when the greeting card is in a closed position and an unfolded, upright position when the greeting card is in an open position.

17. The pop-up greeting card of claim 14, wherein the trigger mechanism is spring-loaded.

18. The pop-up greeting card of claim 14, wherein the trigger mechanism is a pull string.

* * * * *